US006811048B2

(12) United States Patent
Lau

(10) Patent No.: US 6,811,048 B2
(45) Date of Patent: Nov. 2, 2004

(54) FOLD-UP STORAGE CONTAINER

(76) Inventor: David M. K. Lau, 16 Hop Yat Road 4/F KLN, Hong Kong (HK)

( * ) Notice: Subject to any disclaimer, the term of this patent is extended or adjusted under 35 U.S.C. 154(b) by 241 days.

(21) Appl. No.: 10/076,761

(22) Filed: Feb. 12, 2002

(65) Prior Publication Data

US 2003/0150769 A1 Aug. 14, 2003

(51) Int. Cl.[7] ..... B65D 88/00; B65D 19/00

(52) U.S. Cl. ..... 220/1.5; 206/511; 206/600; 220/4.28

(58) Field of Search ..... 206/386, 599, 206/600, 509, 511; 220/1.5, 4.28, 4.29, 4.33, 6.7; 108/55.1, 53.1, 55.3, 56.1

(56) References Cited

U.S. PATENT DOCUMENTS 894,638 A * 7/1908 Heim ..... 220/4.29
3,346,137 A * 10/1967 Ricci ..... 206/511
3,398,850 A * 8/1968 Henry ..... 220/1.5
3,853,238 A * 12/1974 Luisada et al. ..... 220/1.5
4,673,087 A * 6/1987 Webb ..... 206/600
4,889,235 A * 12/1989 Hess ..... 206/511
4,917,047 A * 4/1990 Wazeter, III ..... 119/474
5,161,709 A * 11/1992 Oestreich, Jr. ..... 220/1.5
5,507,237 A * 4/1996 Barrow et al. ..... 206/600
6,216,899 B1 * 4/2001 Vicari ..... 220/1.5

* cited by examiner

*Primary Examiner*—Luan K. Bui
(74) *Attorney, Agent, or Firm*—William L. Chapin

(57) ABSTRACT

A freight storage container includes six rectangularly-shaped panels including a base panel, a front end panel hingedly fastened to a front edge of the base panel and pivotable into overlying contact therewith, and a rear panel hingedly fastened to a rear edge of the base panel and pivotable downwards to overlie the front end panel. The container is assembled on-site by folding upwardly the rear and front panels, installing two side panels in the base, and fastening a roof panel to upper peripheral edge walls of the side and end panels, by novel fastener joints each consisting of a tubular hinge lug member protruding downwards from a lower inside surface of the roof panel, a coaxially aligned tubular side panel hinge lug member protruding inwardly from a side panel, and a stainless steel friction pin forced into an interference fit within coaxially aligned bores of the two lugs.

26 Claims, 9 Drawing Sheets

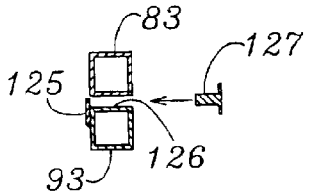
Fig. 10
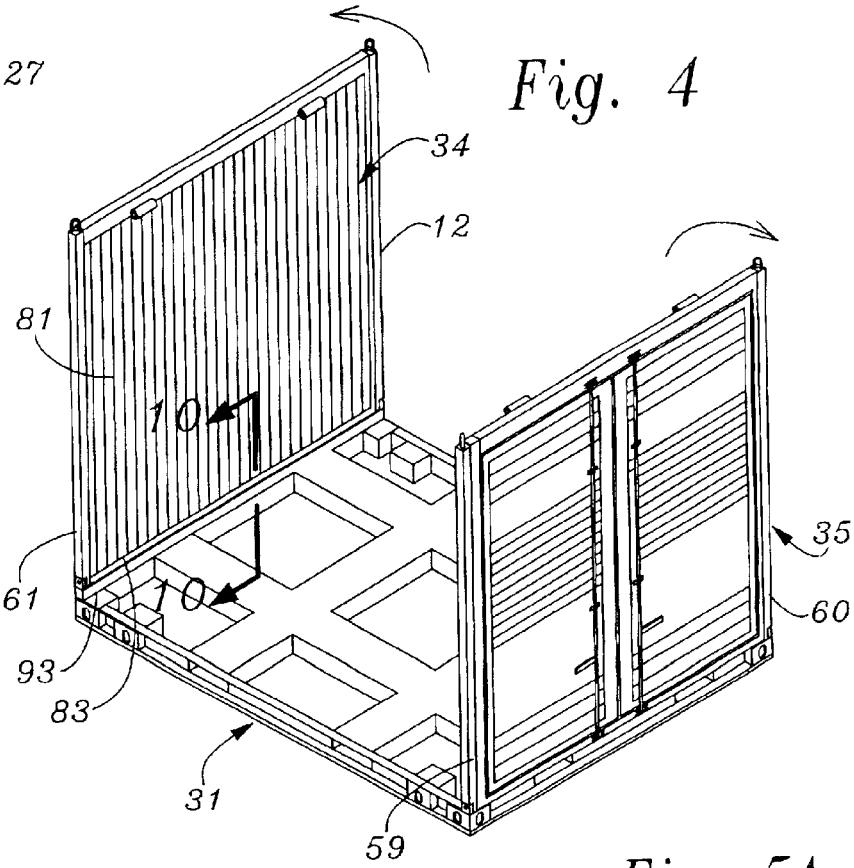
Fig. 4
Fig. 5A
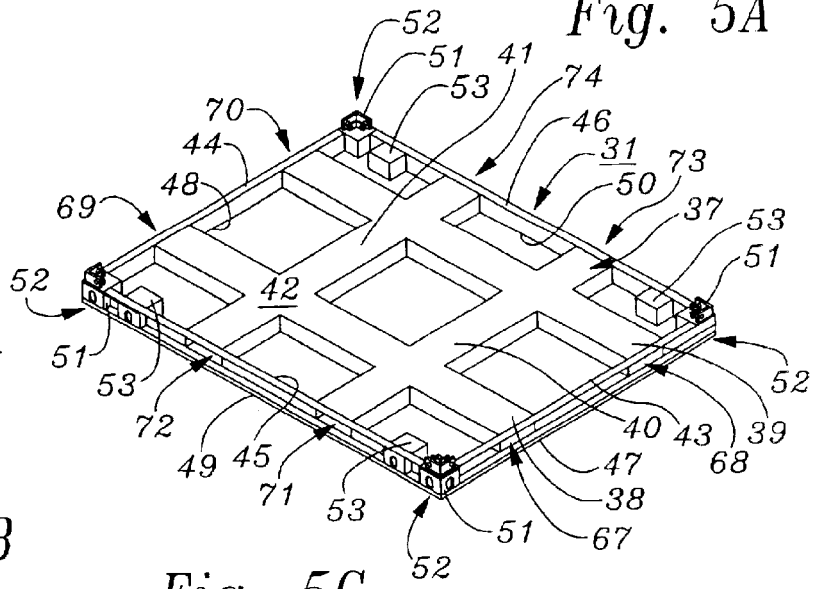
Fig. 5D
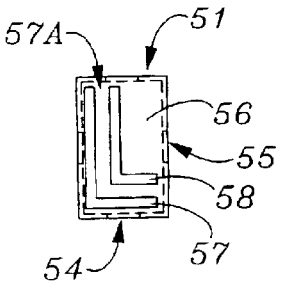
Fig. 5B
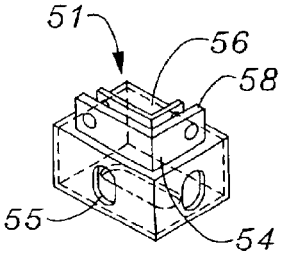
Fig. 5C
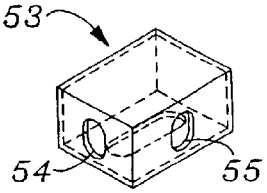

FOLD-UP STORAGE CONTAINER

BACKGROUND OF THE INVENTION

1. Field of the Invention

The present invention relates to containers of the type used to store goods such as articles of freight being temporarily held at a shipping source or destination. More particularly, the invention relates to a fold-up storage container which may be transported to a storage site in a relatively flat, compact package, and folded upwards therefrom to construct a walk-in container which is closable and lockable to secure goods placed within the container from pilferage and damage by the elements.

2. Description of Background Art

Containers used to store goods at warehouses, wharves and similar locations typically consist of rectangularly-shaped box-like structures which are constructed from rectangularly-shaped metal panels that are fastened together to form the container. The panels are customarily made of corrugated steel plates which are bolted or welded together to form the container. Most such containers have a front end panel provided with one or more doors which may be pivoted open on vertical axes to allow access to the interior space of the container, and pivoted closed and locked to secure goods within the containers. Although such containers are available in a variety of sizes, they usually have a height of 8 feet or more to afford easy access to the interior of a container by workmen and materials handling equipment such as hand trucks. The width and length dimensions of such containers are also variable, typical width and length values being eight feet and ten feet, respectively.

From the foregoing description, it can be readily appreciated that industrial containers of the type described are relatively bulky. There fore, shipping such containers from a manufacturing plant to a use site such as a warehouse or wharf is relatively expensive. For that reason, among others, it would be desirable to have available an industrial storage container which could be shipped in a collapsed, or more compact configuration that would occupy less volume than a fully assembled and operational container. In apparent recognition of the desirability of have containers which may be transported in a collapsed form, a number of inventors have disclosed such containers, including Effird, U.S. Pat. No. 4,830,211, Collapsible Moving And Storage Container, Hawkins, U.S. Pat. No. 4,966,310, Collapsible Storage Container And Method For Storing Matter; Pflueger, U.S. Pat. No. 5,257,830, Collapsible Freight And Storage Container; Hart, U.S. Pat. No. 5,595,305, Collapsible Storage Container, and Hart, U.S. Pat. No. 6,006,918, Collapsible Storage Container.

The present invention was conceived of to provide a fold-up storage container which has structural and operational characteristics that enable the container to be shipped to a use site in a compact, relatively flat package, and be assembled on-site into a storage container for securing articles against the elements and pilferage.

OBJECTS OF THE INVENTION

An object of the present invention is to provide a storage container including sub-assembly components which all may be transported in a relatively thin package, and readily folded-up and fastened together at a use site to assemble a useable storage container.

Another object of the invention is to provide a fold-up storage container having pairs of wall panels joinable together with pairs of mating tubular fastener lugs, each joint being secured by means of a hinge pin received in interference fits in the bores of the lug pair.

Another object of the invention is to provide a fold-up storage container including a base which has a skeletal base frame made of hollow rectangular tubes arranged in a rectangular grid, outer peripheral edges of the tubes at the sides of the base being provided with pairs of spaced apart openings which are adapted to received a pair of laterally spaced apart forks protruding forward from a fork-lift truck.

Another object of the invention is to provide a fold-up storage container which has at each corner of a base frame thereof a pair of perpendicularly oriented, identical connector castings including a corner casting located at the corner intersection of sides of the base, and an offset casting located on an edge of the base spaced inwards from the corner, the connector castings being adapted to couple together with corresponding connector castings of additional such storage containers in both side-by-side and end-to-end arrangements.

Another object of the invention is to provide a fold-up shipping container having at the corners of a roof panel thereof L-shaped stacking blocks which both enable a plurality of containers to be stacked vertically, while protecting a lifting ring protruding upwards from an end post at each corner from damage when the containers are stacked.

Another object of the invention is to provide a fold-up storage container which includes a roof panel that has a downwardly protruding, horizontally disposed rectangular ring comprised of four rectangular cross section ribs, the ring fitting concentrically within a horizontally disposed peripheral ring formed by four horizontally disposed square cross section ribs located at upper peripheral edges of side and end panels of the container.

Another object of the invention is to provide a fold-up storage container which includes a roof panel that has a downwardly protruding, horizontally disposed rectangular ring comprised of four triangular cross section ribs, the ring fitting concentrically within a horizontally disposed peripheral ring formed by four triangular cross section ribs located at upper peripheral edge of side and end panels of the container.

Another object of the invention is to provide a fold-up container having vertical end posts each capped at an upper end thereof by a sloping end plate adapted to drain water from a roof panel of the container.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a storage container for freight and other such goods, the container being transportable to a storage site in a substantially flat or knocked-down configuration, and readily assembled into a fully operational and useable storage container by means of simple assembly steps performable by relatively low skill-level workmen, the steps including folding up subassembly components from a parallel, flattened configuration to a perpendicular, upright position.

A basic embodiment of a fold-up storage container according to the present invention includes a rectangularly-shaped, generally planar base frame, a pair of generally rectangularly-shaped side panels, a pair of front and rear rectangularly-shaped end panels protruding upwards from the base frame, and a rectangularly-shaped roof panel overlying the side and end panels. Preferably, the front and rear end panels are hingedly or pivotably fastened to front and rear edge walls of the base panel. In this arrangement, one panel, e.g., the front end panel is pivoted downwards to a parallel overlying relationship relative to the base frame, and the other panel, e.g., the rear end panel is pivoted parallel to and overlying the front panel and base panel to form a relatively thin, rectangularly-shaped subassembly sandwich. A first step in assembling that embodiment of a fold-up container according to the present invention consists of folding up the rear end panel to an upright, vertical disposition, perpendicular to the base frame. Next, the front end panel is similarly folded up to a vertical orientation. Left and right vertically disposed side panels are then attached to opposite sides of the base frame. Then, a roof or hat panel is installed over the upper peripheral edges of the front and rear end panels, and the two side panels, and secured thereto to form a rigid, completely assembled storage container.

According to one aspect of the invention, each side panel and end panel is securely fastened to the roof panel by two or more fastener joints of novel construction and function. Each such joint consists of a pair of adjacent coaxially aligned, horizontally disposed tubular hinge lug members, one lug protruding downwardly from the roof panel, and a mating lug protruding inwardly from an inner surface of a vertically disposed side or end panel, that lug being located a short distance below the upper peripheral edge of a vertical panel. Each pair of roof and vertical panel tubular lug members is spaced longitudinally apart a distance slightly greater than the length of each lug, so that adjacent end faces of the lug pair are spaced a short distance apart. Each lug pair is fastened together by a stainless steel pin which is forced into an interference fit within the coaxially aligned, horizontally disposed bores of a pair of adjacent lugs.

According to another aspect of the invention, each roof panel tubular hinge fastener lug protrudes downwardly from a horizontally disposed ring which is concentric with the roof panel, the ring being formed of four straight, square cross-section tubular ribs arranged into a rectangle. The outer vertical surfaces of opposed parallel pairs of roof ring ribs are spaced slightly closer together than the inner vertical surfaces of pairs of upper peripheral ribs which protrude upwards from pairs of side and end panels. This arrangement allows the roof ring to be insertably received within a ring formed by end and side panel upper peripheral ribs. The roof panel preferably has a downwardly located peripheral flange spaced outwardly from the roof ring ribs, at a distance slightly greater than the spacing between outer corresponding surfaces of the end panel and side panel upper peripheral ribs, thus overlapping the end and side panels to form a weather-tight seal. In a variation of this aspect of the invention, both the roof and side and end panel ribs have right triangular cross-sectional shapes, the hypotenuses of the ribs angling downwardly towards the center of the container and conformally contacting one another in a dual ramp arrangement to facilitate sliding the roof panel into place atop the side and end panels.

According to another aspect of the invention, the base of the container has a skeletal frame made of four hollow rectangular tubes arranged into a rectangular grid having in plan view the outline of a double-barred cross. Outer peripheral faces of each of the four tubes have rectangularly-shaped openings which form pairs of the proper size and spacing to receive a pair of forks protruding from a fork lift truck. With this arrangement, a fork lift truck may engage and lift any of the four sides of the container base.

According to another aspect of the invention, a pair of rectangular block-shaped connector castings is installed at each of the four corners of the base, each connector casting having a pair of mutually perpendicular bolt bores. A first, corner connector casting is located directly at a base corner, and a second, offset connector casting is rotated 90 degrees and spaced longitudinally a short distance along an edge of the base, inwards from the corner. This arrangement enables pairs of connector castings of adjacent containers to be fitted together in both side-by-side and end-to-end configurations, and bolted together to secure the containers in a selected configuration.

According to another aspect of the invention, a tubular L-shaped stacking block protrudes upwardly from each of the four corners of the roof panel, the stacking blocks enabling a plurality of containers to be stacked vertically, while protecting a lifting ring installed at each corner from damage when the containers are vertically stacked.

According to another aspect of the invention, the container has vertically disposed end posts at each corner thereof, each end post being capped at an upper end thereof with a sloping end plate that holds a lifting ring and is sloped to facilitate draining rain water of the roof panels.

BRIEF DESCRIPTION OF THE DRAWINGS

FIG. 4 is a partly skeletal view similar to that of FIG. 3, but showing a front panel thereof pivoted upwards from the base.

FIG. 5 is a fragmentary perspective view of a base panel of the container of FIG. 4.

FIG. 10 is a fragmentary view of the container subassembly of FIG. 4, showing details of a weather-proofing seal strip in a panel hinge gap of the subassembly.

DESCRIPTION OF THE PREFERRED EMBODIMENTS

Figure 17:
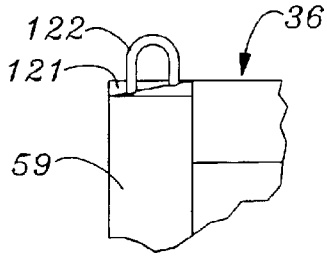
FIG. 17 is a fragmentary view of the container of FIG. 11, showing a pair of diagonally opposed lifting rings thereof.
Figure 18:
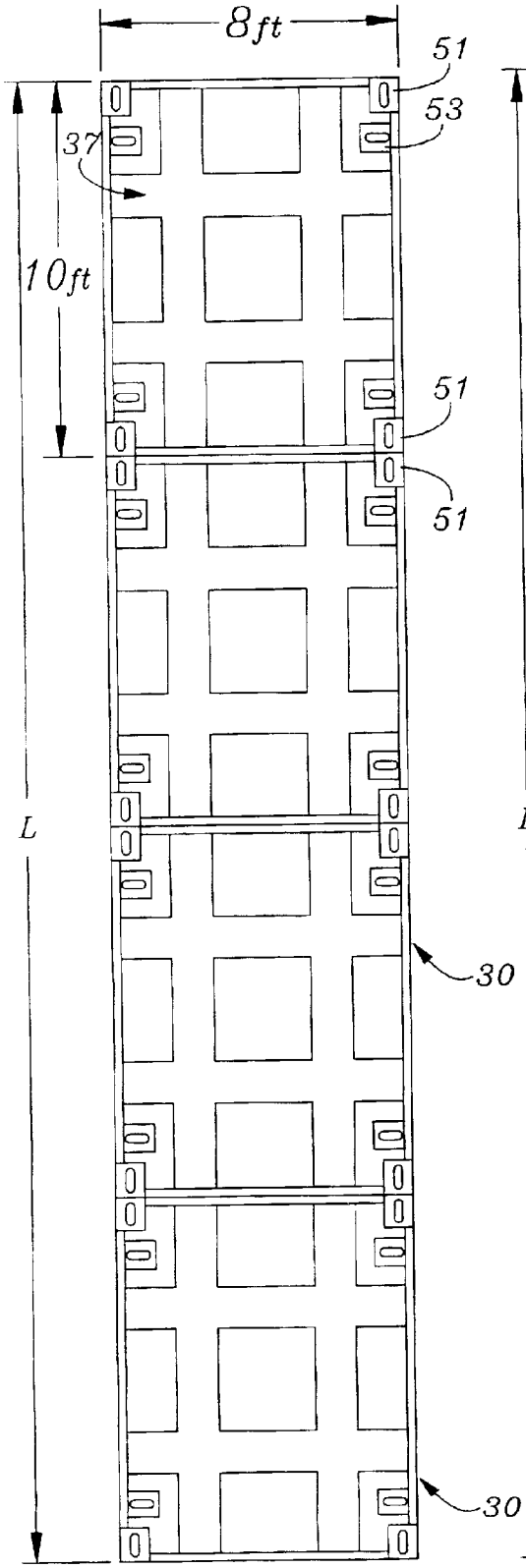
FIG. 18 is a diagrammatic plan view showing a plurality of containers shown in FIG. 11 coupled together in a tandem configuration.
Figure 19:
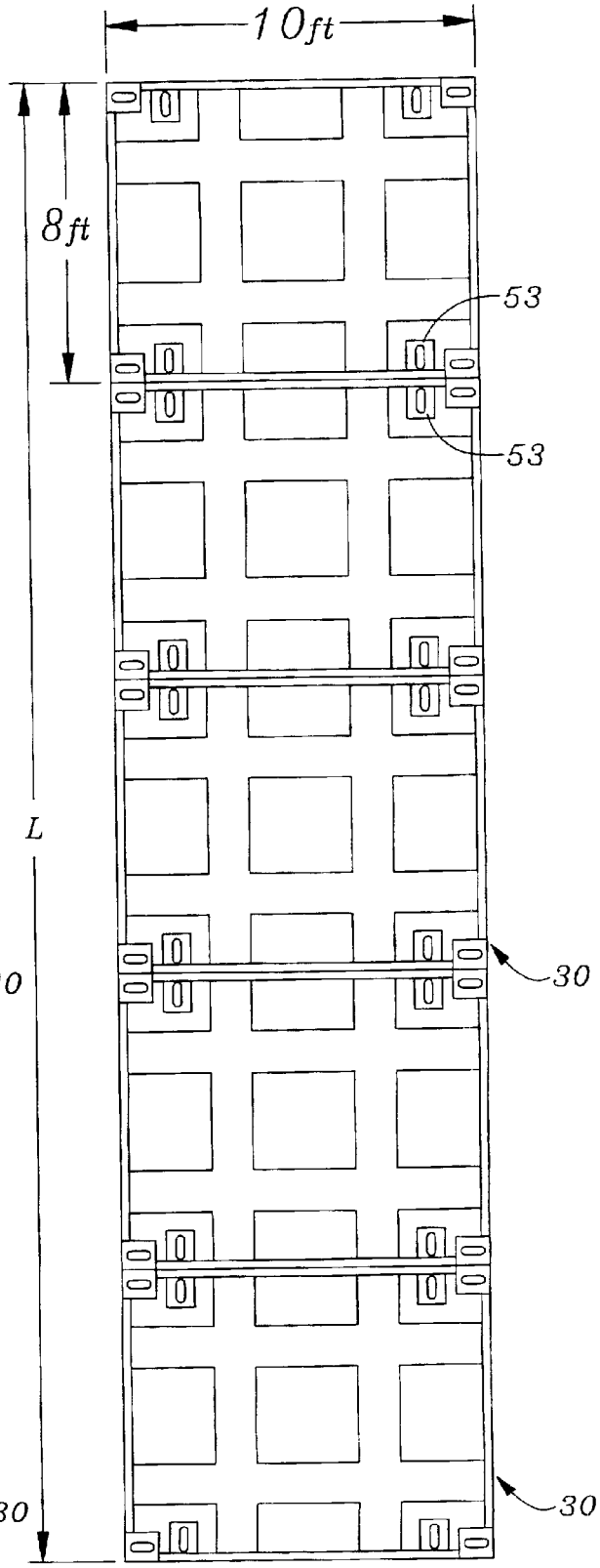
FIG. 19 is a diagrammatic plan view showing a plurality of the containers shown in FIG. 11 coupled together in a side-by-side configuration.
Figure 20:
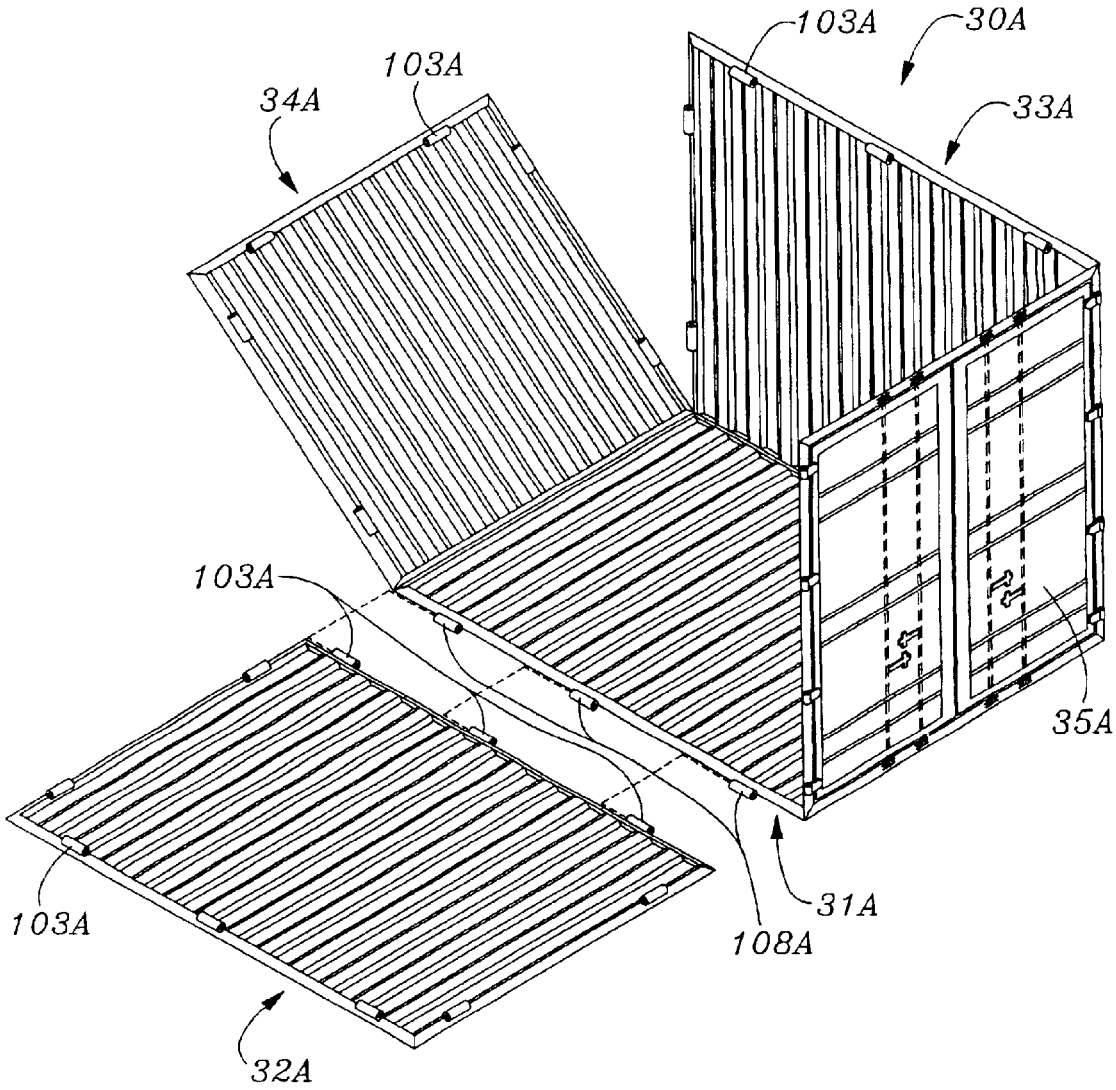
FIG. 20 is a fragmentary perspective view of an alternate embodiment of a fold-up storage container according to the present invention.

In the ensuing description, FIGS. 1–17 illustrate a fold-up storage container according to the present invention, while FIGS. 18 and 19 illustrate how a plurality of fold-up storage containers according to the present invention may be coupled together. FIG. 20 illustrates an alternate embodiment of a fold-up storage container according to the present invention.

Figure 1A:
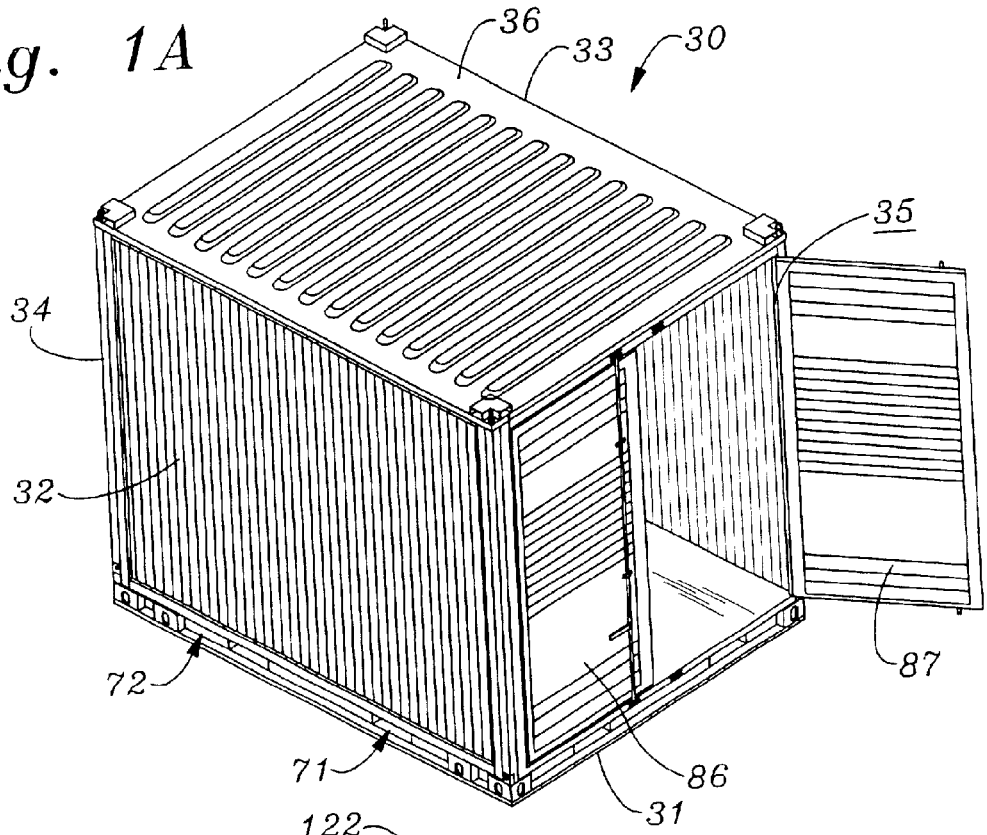
FIG. 1 is an upper perspective view of a fold-up storage container according to the present invention.
Figure 1B:
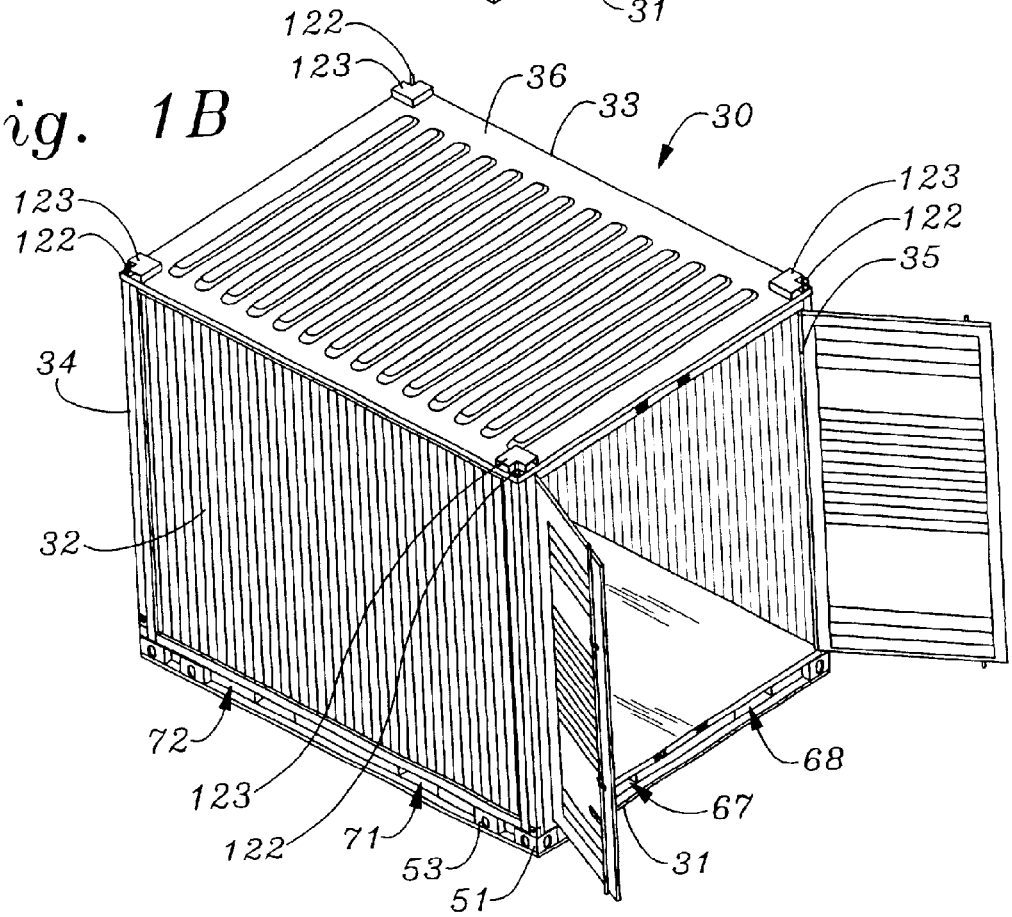

More specifically, FIG. 1 illustrates a fully assembled fold-up storage container 30 according to the present invention, FIGS. 2–7 show component parts of container 30, including subassemblies which are folded up from a compact arrangement suited for transporting and storing an unassembled container, and FIGS. 9–17 illustrate structural details of storage container 30.

Figure 7:
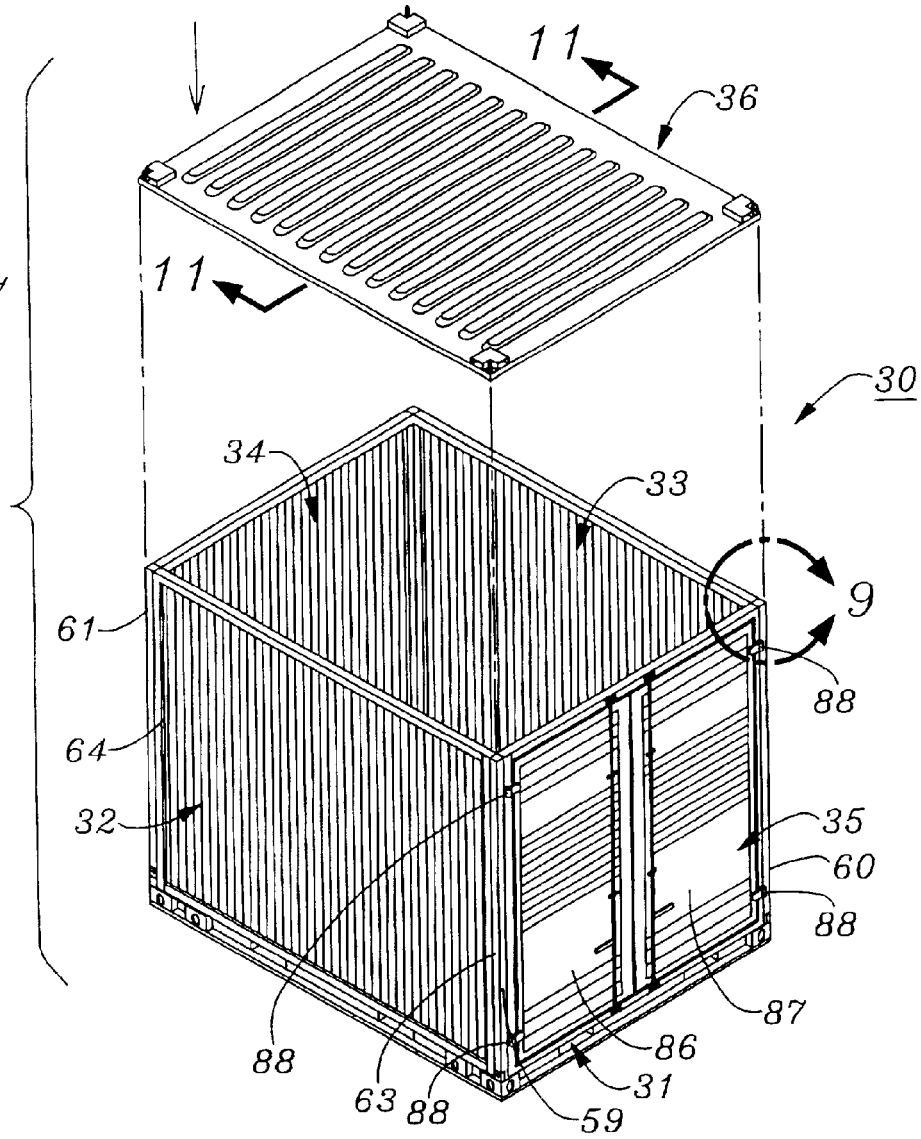
FIG. 7 is a perspective view of the container subassembly of FIG. 6, showing a roof panel thereof in position to be installed onto the subassembly.
Figure 9:
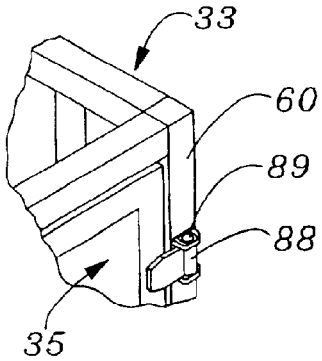
FIG. 9 is a fragmentary view of the container subassembly of FIG. 7, showing details of a front door hinge thereof.

Referring first to FIGS. 1 and 7, a fold-up storage container 30 according to the present invention may be seen to include a plurality of generally flat, rectangularly-shaped panels which are fastened together to form a generally rectangularly-shaped, box-like enclosure, the panels including a base panel 31, left and right side panels 32, 33, rear panel 34, front door panel 35, and roof panel 36. As shown in FIG. 5, base panel 31 includes a skeletal frame 37 which comprises essentially a pair of laterally spaced apart, longitudinally disposed left and right hollow rectangular tubes 38, 39, which perpendicularly intersect a pair of longitudinally spaced apart laterally disposed front and rear hollow rectangular tubes 40, 41. Tubes 38, 39, 40 41 have a coplanar, coextensive upper surface 42 and, arranged as described above, have in plan view the shape of a double-barred cross. As shown in FIG. 5, tubes 38, 39, 40, 41 may be roll formed from a single steel sheet. Moreover, the bottoms of the tubes may be open.

Referring still to FIG. 5, it may be seen that base panel 31 includes upper and lower elongated rectangularly-shaped peripheral ribs joined to the upper and lower outer peripheral edge surfaces of tubes 38, 39, 40 and 41, the upper ribs including front and rear ribs 43, 44, and left and right ribs 45, 46, and the lower ribs include front and rear ribs 47, 48 and left and right ribs 49, 50. Ribs 43, 44, 45, 46, 47, 49, 40 and 50 are fastened to skeletal tubes 38, 39, 40 and 41.

Figure 6:
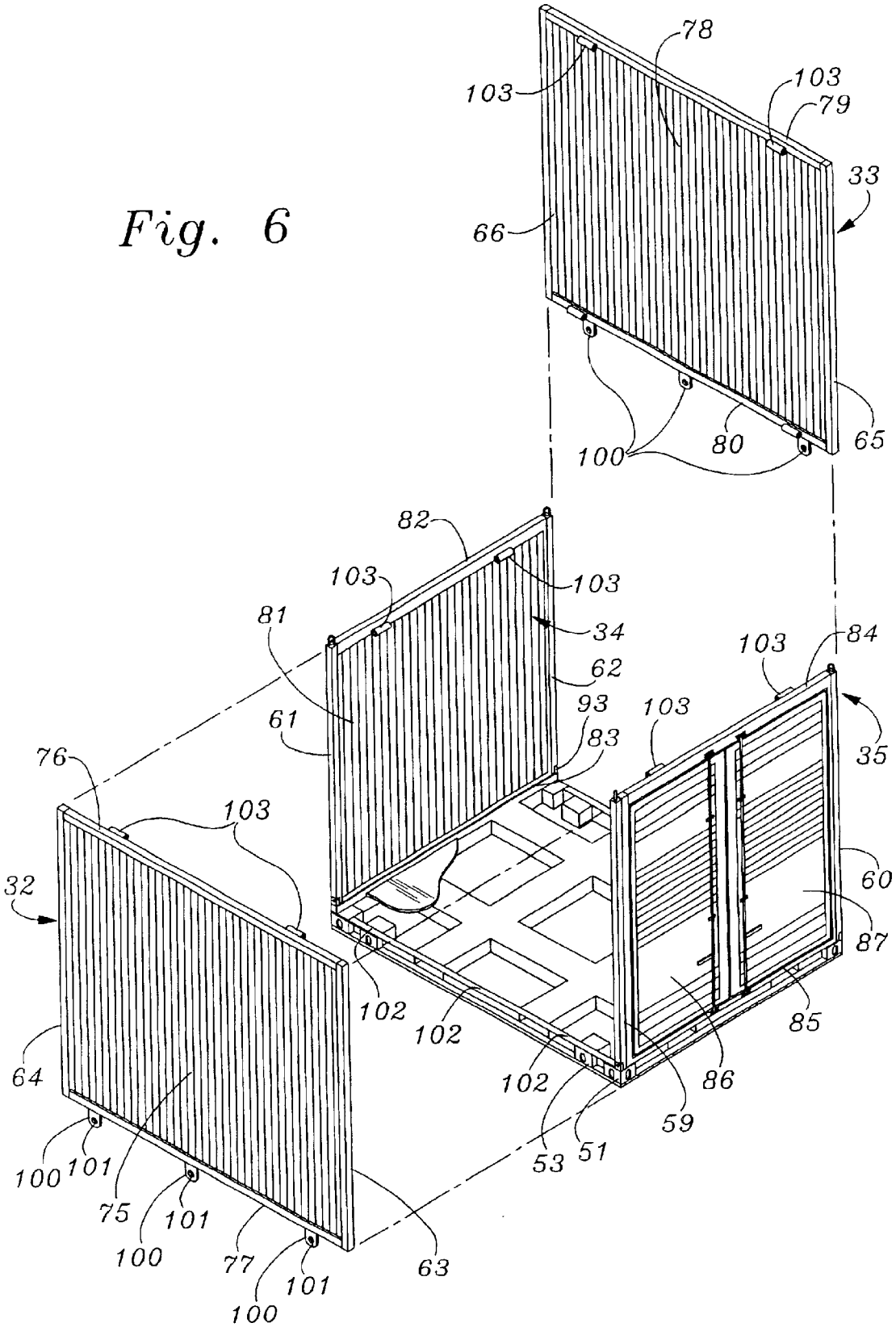
FIG. 6 is a perspective view of the container subassembly of FIG. 4, showing the manner of installing side panels thereof.

Referring still to FIG. 5, it may be seen that base panel 31 includes a box-shaped base corner connector casting 51 at each of the four corner intersections 52 of a pair of ribs, the corner connector casting being located between upper and lower internal rib pairs. Base panel 31 also includes an offset base connector casting 53 located longitudinally inwards of each corner connector casting 51. Each offset connector casting 53 is structurally identical to a corner connector casting 51. Thus, as seen in FIG. 5, each corner connector casting 51 has a longitudinally elongated, rectangular shape which has a circular hole 54 in a short end face and a circular hole 55 in a long side face thereof. As shown in FIG. 5, corner connector castings 51 are oriented with holes 55 oriented in a fore and aft direction, while offset connector castings 53 are oriented with hole 55 disposed in a lateral direction. As shown in FIG. 5, corner connector castings 51 have protruding perpendicularly upwards from the upper surface 56 thereof a pair of parallel, diagonally spaced apart outer and inner L-brackets 57, 58. As shown in FIGS. 4, 5 and 6, a space 57A between L-brackets 57, 58 is formed for receiving left and right vertical end ribs 59, 60 of front door panel 35, left and right vertical end ribs 61, 62 of rear panel 34, front vertical end rib 63 of left side panel 32, rear vertical end rib 39 of left side panel 32, and front and rear vertical end ribs 65, 66 of right side panel 33. Each connector casting 51, 53 also has in a bottom wall 127 thereof a longitudinally elongated, oval-shaped hole which allows a wrench to be inserted therethrough to engage a nut on a connector bolt inserted into hole 54 or 55.

Figure 3:
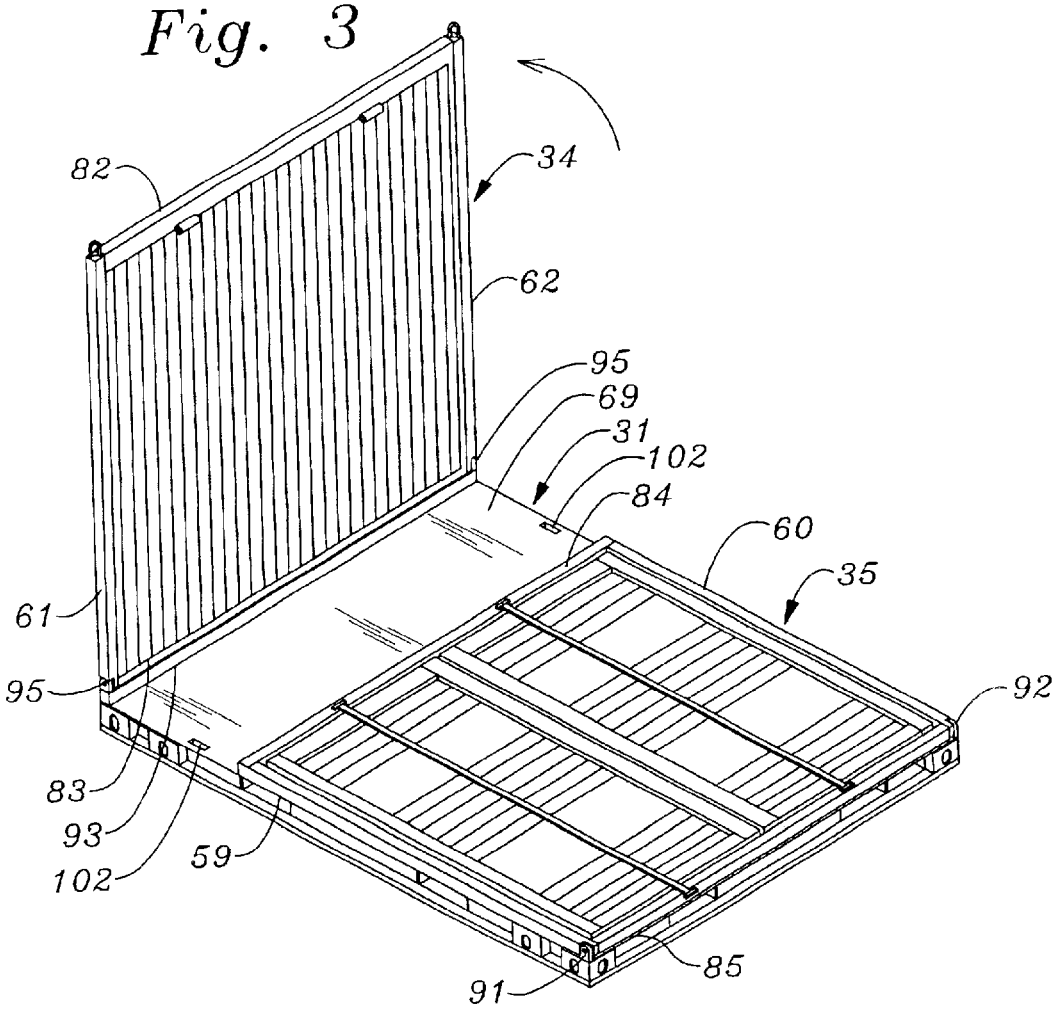
FIG. 3 is a view similar to that of FIG. 2, but showing a rear panel thereof pivoted upwards from the base.

Bores 54, 55 are provided to receive bolts to secure two or more containers together both side-by-side and end-to-end arrangements as shown in FIGS. 18 and 19 and described below. As shown in FIG. 3, skeletal frame 37 of base panel 31 is preferably covered by a steel plate 69 welded to tubes 38, 39, 40, 41.

Referring again to FIG. 5, it may be seen that longitudinally disposed tubes 38, 39 of skeletal base frame 37 have horizontally elongated rectangularly-shaped front openings 67, 68 and rear openings 69, 70, which are coplanar with front and rear vertical edges of base panel 31. Openings 67, 68, 69 and 70 are of the proper size, shape and spacing to insertably receive a pair of forks protruding forward from a fork lift truck. Similarly, laterally disposed skeletal frame tubes 40 and 41 have horizontally elongated rectangularly-shaped left side openings 71, 72 and right side openings 73, 74, which are coplanar with left and right vertical edges of base panel 31. Openings 71, 72, 73, 74 are also of the proper size, shape and spacing to insertably receive a pair of forks protruding from a fork lift truck. With this arrangement, container 30 may be lifted by a fork lift truck approaching container 30 from any of its four sides. If tubes 38, 39, 40 and 41 are optionally fabricated with open bottoms, i.e., as C-sections rather than rectangular sections, a short rectangular plate (not shown) is welded on the bottom of each tube adjacent openings 67–74, to form a complete tubular section for insertably receiving a fork lift fork.

As shown in FIG. 6, left and right side panels 32 and 33, and rear panel 34 of container 30 are all of similar construction, preferably being fabricated from rectangularly-shaped corrugated steel sheet plates bounded by square cross-section tubular steel ribs. Thus, as shown in FIG. 6, left side panel 32 includes a rectangularly-shaped corrugated steel plate 75 bordered by front and rear square cross-section vertical peripheral ribs 63, 64 and upper and lower peripheral ribs 76, 77. Similarly, right side panel 33 includes a rectangularly-shaped, corrugated steel plate 78 bordered by front and rear square cross-section vertical peripheral ribs 65, 66 and upper and lower peripheral ribs 79, 80.

Referring still to FIG. 6, it may be seen that rear panel 34 includes a rectangularly-shaped, corrugated steel plate 81 bordered by left and right square cross-section vertical peripheral ribs 61 and 62, and upper and lower peripheral ribs 82, 83.

Front panel 35 is constructed similarly to rear panel 34, and has left and right vertical peripheral ribs 59, 60. However, instead of including a single rectangularly-shaped corrugated steel plate bordered by left and right vertical peripheral ribs 59, 60, and upper lower ribs 84, 85, front panel is desirably provided with at least one and preferably two doors 86, 87. The latter are hingedly coupled to vertical side peripheral members 59, 60, by means of hinges 88 that have vertically disposed hinge pins 89.

Figure 2:
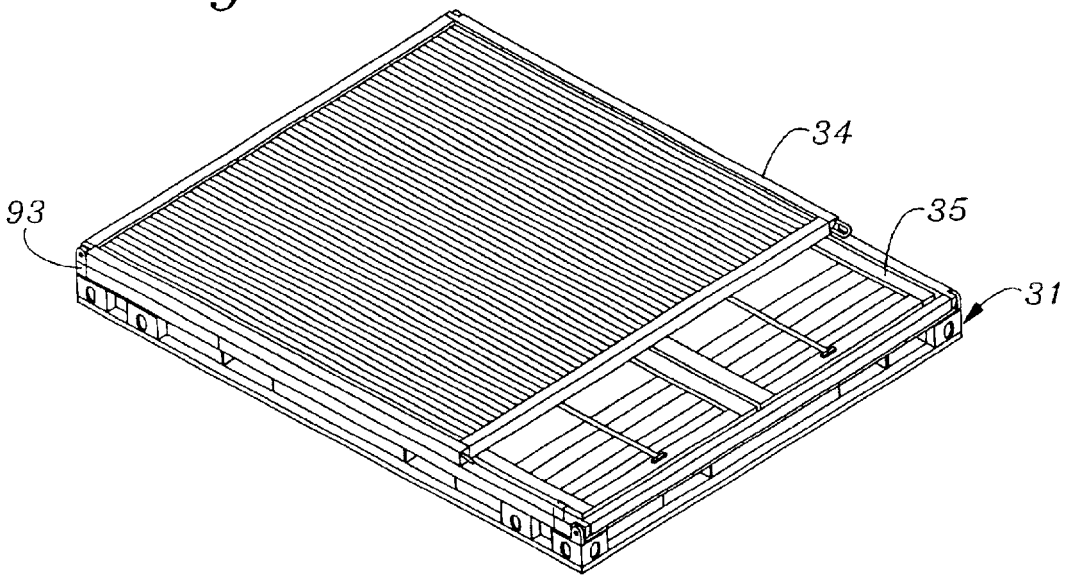
FIG. 2 is a perspective view of a folded down subassembly of the container of FIG. 1, including a base panel, rear and front panels thereof.

Referring now to FIGS. 2, 3 and 4, it may be seen that front and rear panels 35, 34 are preferably hingedly or pivotably fastened to base panel 31. Thus, as shown in FIG. 3, lower laterally disposed peripheral rib 85 of front panel 35 is hingedly coupled to an upper front laterally disposed edge surface 90 of base 31 by a pair of laterally spaced apart hinges 91, 92. The latter have collinear horizontally disposed hinge or pivot axes which enable front panel 35 to pivot upwardly from a knocked down position, parallel to and overlying base panel 31, as shown in FIGS. 2 and 3, to an upright vertical position perpendicularly to base panel 31, as shown in FIG. 4. Similarly, as shown in FIGS. 2 and 3, lower laterally disposed peripheral rib 83 of rear panel 34 is hingedly coupled to a laterally disposed, square cross-section riser rib 93, fastened to an upper rear laterally disposed edge surface 94 of base 31, by a pair of laterally spaced apart hinges 95, 96. Hinges 95, 96 have collinear, horizontally disposed pivot axes which enable rear panel 34 to pivot upwardly from a knocked down position, parallel to and overlying front panel 35 and base panel 31, as shown in FIG. 2, to an upright vertical position perpendicular to the base, as shown in FIGS. 3 and 4. Riser rib 93 is provided to enable lower panel 34 to overlie front panel 35 in a flat, parallel disposition as shown in FIG. 2.

A method of folding up subassembly components of container 30 from a knocked-down configuration, as shown in FIG. 2, and of fastening components of the container together to assemble an erected container, as shown in FIG. 1, may be best understood by referring to FIGS. 2–12.

As shown in FIG. 2, a first step in assembling a container 30 from subassembly components consists of pivoting rear panel 34 into an upright vertical position as shown in FIGS. 3 and 4, and then pivoting front panel 35 to an upright position as shown in FIG. 4. Next, as shown in FIG. 6, left and right side panels 32 and 33 are fastened to base panel 31, in a manner which will be described below. Finally, as shown inn FIG. 6, roof panel 36 is fastened to front and rear panels 35, 34, and left and right side panels 32, 33, in a manner which is also described below.

Referring now to FIG. 6, it may be seen that left and right side panels 32, 33, each has protruding downwards from respective lower peripheral ribs 77, 80 thereof a plurality of generally flat, vertically disposed lugs 100. Lugs 100 have generally flat outer and inner surfaces, which are coplanar with corresponding surfaces of adjacent lugs, e.g., front, middle and rear lugs as shown in FIG. 6. Each lug has through its thickness dimension a hole 101 adapted to receive a fastener bolt (not shown). Also, a plurality of rectangular-shaped, vertically disposed holes 102 is provided through base panel 31 at both left and right longitudinally aligned peripheral edges thereof, for receiving lugs 100, which are secured to the base panel by any convenient means, such as a bolt (not shown) passing through hole 101 of each lug.

Figure 13:
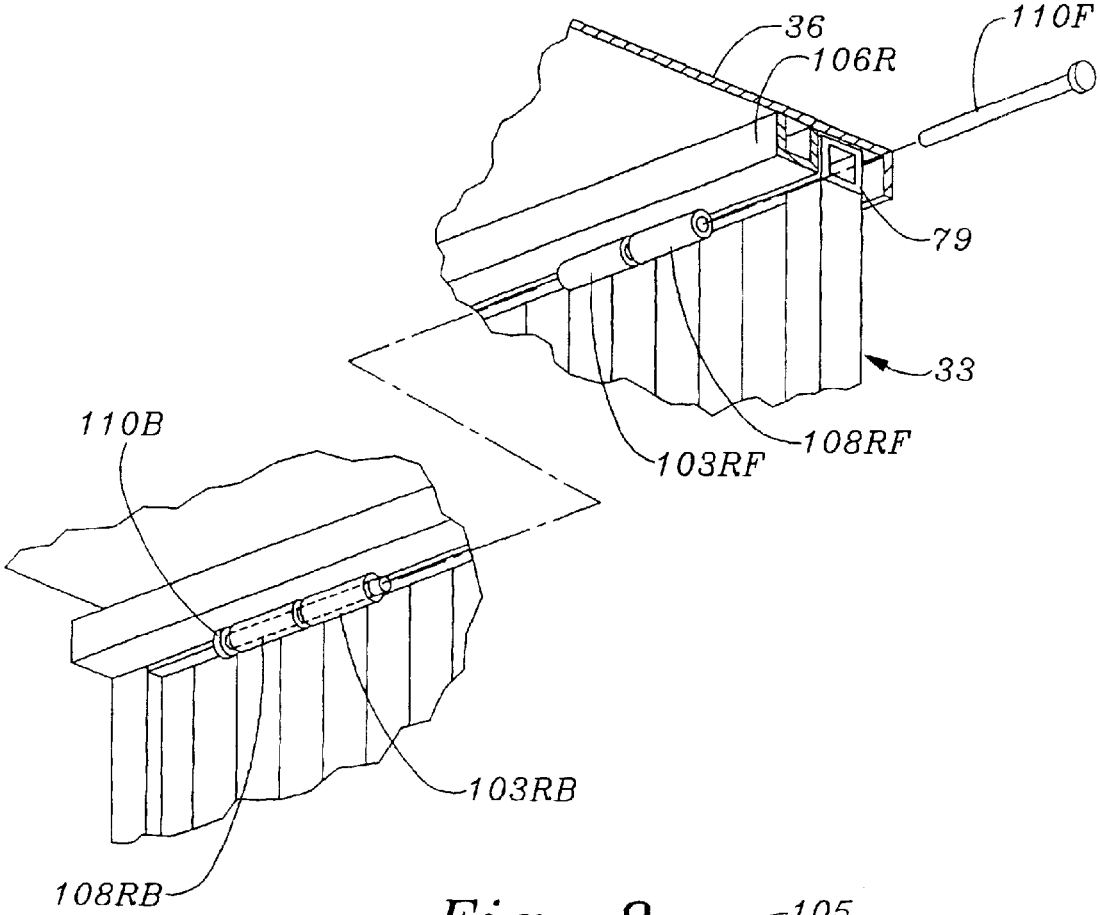
FIG. 13 is a fragmentary perspective view of the container subassembly of FIG. 11, showing the manner of joining tubular fasteners thereof.
Figure 8:
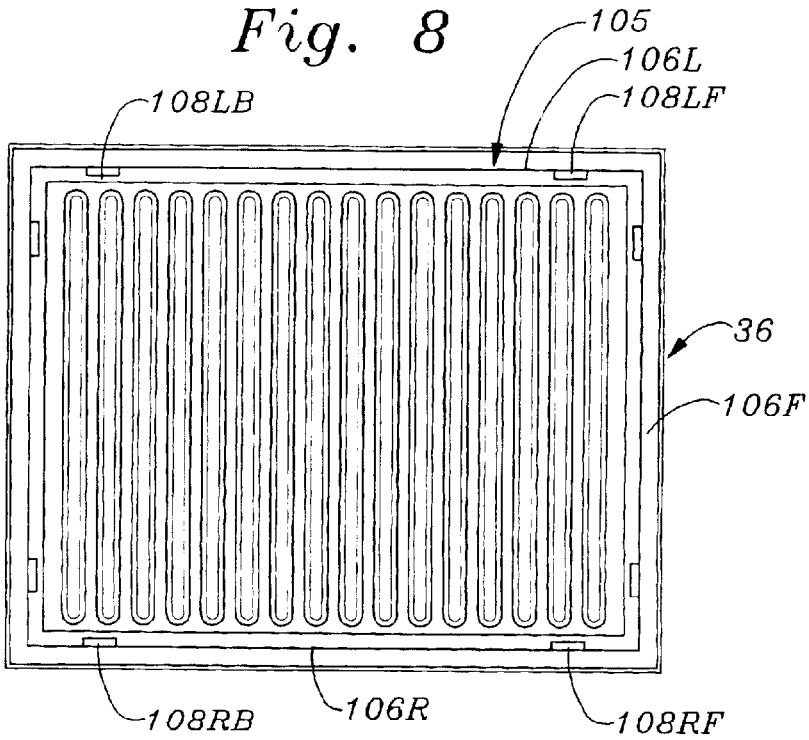
FIG. 8 is a lower plan view of the roof panel shown in FIG. 7.
Figure 11:
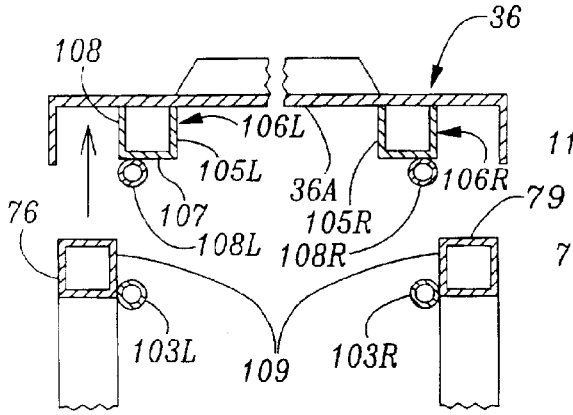
FIG. 11 is a fragmentary transverse sectional view of the container subassembly of FIG. 7, taken along in the direction of line 11—11.
Figure 12:
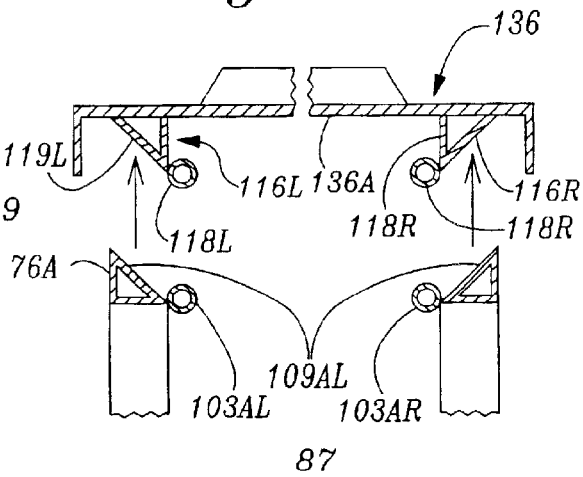
FIG. 12 is a fragmentary transverse sectional view similar to that of FIG. 11, but showing a modification of the container subassembly in which tubular fastening ribs of both the roof panel and the side and end panels thereof have triangular rather than square cross sections.

Referring still to FIG. 6, it may be seen that upper, horizontally disposed peripheral edge ribs 82, 84, 76, 79 of rear panel 34, front panel 35, left side panel 32 and right side panel 33, respectively, each has protruding laterally inwards from inner vertical wall surfaces of the ribs at least one pair of spaced apart, coaxially aligned tubular vertical panel hinge connector lugs 103. Referring to FIGS. 8 and 11, it may be seen that roof panel 36 has protruding downwardly from a lower, inner horizontally disposed surface thereof a rectangularly-shaped concentric ring 105 formed of four straight, tubular, square cross ribs 106. As shown in FIGS. 8 and 11, each rib 106 of roof ring 105 has protruding downwards from a lower surface 107 thereof a tubular roof-panel hinge connector lug 108. As shown in FIGS. 11 and 13, tubular roof connector lugs 108 have outer surfaces tangent with outer surfaces 108 of roof ribs 106. Also, the distance between outer faces 108 of longitudinally aligned pairs of roof ribs 106 is slightly less than the distance between inner facing walls 109 of vertical panel ribs 76, 79, 82, 84. With this arrangement, roof ring 105 is conformally insertable into a similarly shaped, rectangular opening formed between inner facing wall surfaces 109 of vertical panel ribs 76, 79, 82, 84, as shown in FIGS. 11 and 12. Also, as shown in FIG. 13, longitudinally and coaxially aligned pairs of tubular roof connector lugs, e.g., front and back roof connector lugs 108F, 108B, are spaced apart sufficiently for the inner longitudinal end walls of the roof connector lugs to be spaced slightly outwards of the outer end walls of the vertical panel connector lugs 103.

With roof panel 36 placed on top of side and end panels of container 30 and tubular hinge connector lugs arranged as described above, a stainless steel friction pin 110 is forcibly inserted into an interference fit within cylindrical bores 111,112 of each connector pair comprised of a roof tubular hinge connector lug 108 and a vertical panel connector lug 103, as shown in FIG. 13. With this novel connector arrangement, final assembly of container 30 is quickly and simply accomplished by pre-assembling components of the container into a lidless, box-like configuration, as shown in FIG. 7, lowering roof panel 36 onto the "open box," opening a door 86, 87 in front panel 35, entering the interior space 114 of the container, and forcibly driving a stainless steel connector pin 110 into bores 111, 112 of each adjacent pair of roof and vertical panel connector lugs 108,103.

FIG. 10 illustrates an optional weatherproofing seal structure which may be used to seal hinged joints between base 31 and front or rear panels 35, 34. As shown in FIG. 10, an elongated flat rectangularly-shaped steel strip 125 is welded to a rear surface of riser rib 93, the strip protruding upwardly above an elongated hinge gap 126 between the lower surface of lower peripheral rib 83 of rear panel 34, and the upper surface of riser rib 93. With rear panel 34 pivoted upright with respect to base panel 31, as shown in FIGS. 4 and 10, an elongated T-shaped elastomeric seal strip 127 is forced into gap 126, thus providing an airtight and water-tight seal thereat.

FIG. 12 illustrates a modification of roof panel 36 shown in FIG. 11 and described above. As shown in FIG. 12, modified roof panel 136 has protruding downwardly from a lower, inner horizontally disposed surface 136R thereof a rectangularly-shaped concentric ring 115 formed of tubular ribs 116 that have a triangular, rather than square cross-section. As shown in FIG. 12, each rib 116 of roof ring 115 has protruding outwardly from inner vertical wall surface 117 thereof a plurality of two or more coaxially aligned tubular roof panel hinge connector lugs 118. Referring still to FIG. 12, it may be seen that each right triangular cross-section rib 116 has a lower downwardly and inwardly angled hypotenuse surface 119. Also, each modified upper vertical panel rib 76A, 79A, 82A, 84A has a right triangular cross-sectional shape similar to that of modified roof ribs 116. Thus, each upper panel rib 76A, 79A, 82A, 84A has an upper downwardly and inwardly angled hypotenuse surface 109A. With this arrangement, mating upper and lower hypotenuse surfaces 119–109A of roof ribs 116 and vertical panel ribs 76A, 79A, 82A and 84A serve as double ramps which facilitate relative sliding movement as roof panel 76 is inserted into a rectangular ring-shaped opening formed by the vertical panel ribs, even if dimensions of roof ring 116 and/or the upper peripheral vertical panel ring are slightly out of tolerance.

Figure 15:
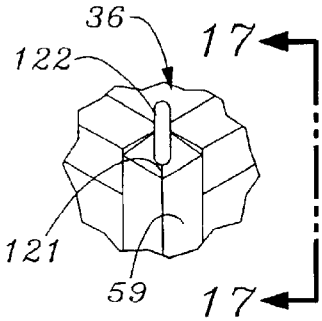
FIG. 15 is a fragmentary perspective view of the container subassembly of FIG. 11, showing a left front vertical corner post thereof with a lifting ring protruding from a sloping drain-shaped cap thereof.

FIGS. 15 and 17 illustrate an angled cap plate 121 installed at the upper end of each vertical end post of container 30, e.g., left front end post 59. As shown in FIGS. 15 and 17, cap plate 121 is angled diagonally downwards and outwards, forming a similarly sloped surface which facilitates draining rain water which might otherwise accumulate on roof panel 36 of container 30. As shown in FIGS. 15 and 17, an upward producing hoisting ring 122 is preferably attached to each cap plate 121 of a corner post 59.

Figure 14:
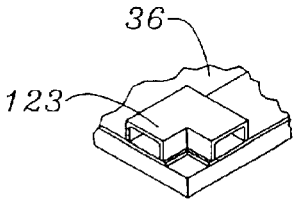
FIG. 14 is a fragmentary perspective view of the roof panel shown in FIG. 11, showing an L-shaped stacking block/lift ring protector thereof.
Figure 16:
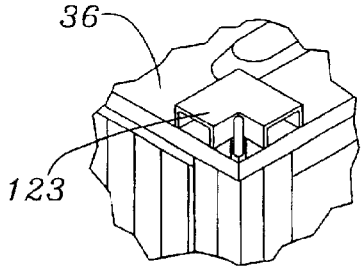
FIG. 16 is a fragmentary view of the container of FIG. 16, showing a roof panel stacking block adjacent an end panel lifting ring.

FIG. 14 illustrates a tubular rectangular cross-section, L-shaped stacking block 123 fastened to the upper surface of roof panel 36, at each of the four corners of the roof panel. With this arrangement, a second container 30 may be stacked on top of a first container 30. As shown in FIG. 16, the height of stacking block 123 is preferably greater than that of lifting ring 122, thus preventing the rings from damage when containers 30 are vertically stacked.

FIGS. 18 and 19 illustrate how a plurality of containers 30 may be fastened in end-to-end and side-by-side arrangements, respectively, using corner connector castings 51 and offset connector castings 53, respectively, FIG. 20 illustrates an alternate embodiment 30A of container 30 in which left and right side panels 32A, 33A are fastened to panel 71A by means of mating hinge connector lug pairs 103A–108A. With this arrangement, loose fitting hinge pins 110A may be temporarily inserted into the bores of pairs of mating tubular hinge connector lugs 103A, 108A, side panels 32A and 33A pivoted upwardly into a vertical position, and loose fitting hinge pins 110A individually replaced by stainless pins 110 forced into interference fits within the bores, after the upper ends of the side panels are secured to a roof pane 136A (not shown).

What is claimed is:

1. A storage container comprising;

a. a base panel which has a rectangular plan-view outline shape, each corner of said base panel having located thereat a corner connector casting comprising a generally rectangularly-shaped box having in an outer face parallel to a first side of said base a bore adapted to insertably receive an elongated fastener member, thereby enabling a pair of said containers to be fastened together in an end-to-end arrangement, b. a plurality of side panels fastenable to said base panel in an upright orientation with respect thereto, c. a roof panel, d. connector means for fastening said roof panel to said side panels, thereby securing said side panels in said upright orientation and forming between inner surfaces of said base panel, side panels and roof panel an enclosed storage space.

2. The container of claim 1 wherein said connector means comprise in combination;

a. a first tubular hinge lug member protruding from a first one of said panels, b. a second, tubular hinge lug member protruding from a second one of said panels adjacent to said first panel and coaxially alignable with said first tubular member, and c. a friction pin inserted into coaxially aligned bores within said first and second tubular hinge members in interference fits therewithin.

3. The container of claim 2 wherein said first panel is further defined as being said roof panel.

4. The container of claim 3 wherein said second panel is further defined as being a side panel.

5. The container of claim 4 wherein said first hinge lug connector member is further defined as protruding downwardly from said roof panel.

6. The container of claim 5 wherein said second hinge lug connector member is further defined as protruding from an upper portion of said side panel.

7. The storage container of claim 1 wherein at least one of said side panels is hingedly fastened to said base panel.

8. The container of claim 1 wherein said base panel is further defined as including a skeletal frame made of a pairs of parallel hollow rectangular channel members having closed upper surfaces and arranged in a rectangular grid, outer peripheral edges of each pair of said channel members being located at a side of the base and having thereat a pair of spaced apart tubular fork openings adapted to insertably receive a pair of laterally spaced apart forks of a fork lift truck.

9. The container of claim 8 wherein at least a first pair of said fork openings is located on a first side of said base, and at least a second pair of said fork openings is located on a second side of said base non-parallel to said first said side.

10. The container of claim 9 further including a third pair of fork openings longitudinally aligned within and located on a third side of said base opposite said first side.

11. The container of claim 10 further including a fourth pair of fork openings longitudinally aligned with and located on a fourth side of said base opposite said second side.

12. The container of claim 1 further including an offset connector casting comprising a rectangularly-shaped box having in an outer face parallel to a second side of said base perpendicular to said first side a bore adapted to insertably receive an elongated fastener member, thereby enabling a pair of said containers to be fastened together in a side-by-side arrangement.

13. A storage container comprising;

a. a base panel which has a rectangular plan-view outline shape, b. a plurality of side panels fastenable to said base panel in an upright orientation with respect thereto, c. a roof panel, said roof panel having at each corner thereof an upwardly protruding stacking block having a flat upper surface adapted to support a lower surface of said base of another such container, said stacking block having a recess formed in a side thereof, said roof panel having located proximate said recess an upwardly protruding hoist ring, said ring having an uppermost edge surface no higher than said upper surface of said stacking block, and d. connector means for fastening said roof panel to said side panels, thereby securing said side panels in said upright orientation and forming between inner surfaces of said base panel, side panels and roof panel an enclosed storage space.

14. A storage container comprising;

a. a base panel, b. a plurality of side panels fastenable to said base panel in an upright orientation with respect thereto, c. a roof panel, said roof panel having protruding downwardly from a lower surface thereof a plurality of at least two roof ribs, said roof ribs forming a ring-shaped structure and being laterally spaced apart a distance enabling said ribs to be insertably received between inner surfaces of upper ends of said side panels, and d. connector means for fastening said roof panel to said side panels, thereby securing said side panels in said upright orientation and forming between inner surfaces of said base panel, side panels and roof panel an enclosed storage space.

15. The container of claim 14 wherein said roof ribs forming said ring-shaped roof rib structure are further defined as having a uniform cross sectional shape.

16. The container of claim 15 wherein said cross sectional shape is further defined as being rectangular.

17. The container of claim 15 wherein said cross-sectional shape of said roof ribs is further defined as being that of a right triangle, said triangle having a downwardly and radially inwardly angled hypotenuse.

18. A storage container comprising;

a. a base panel, b. a plurality of side panels fastenable to said base panel in an upright orientation with respect thereto, c. a roof panel, said roof panel having protruding downwardly from a lower surface thereof a plurality of at least two roof ribs which are laterally spaced apart a distance enabling said ribs to be insertably received between inner surfaces of upper ends of said side panels, and said roof panel having protruding downwards therefrom a peripheral flange spaced radially apart from said roof ribs to form therewith a channel adapted to insertably receive an upper end surface of said side panels, and d. connector means for fastening said roof panel to said side panels, thereby securing said side panels in said upright orientation and forming between inner surfaces of said base panel, side panels and roof panel an enclosed storage space.

19. The container of claim 18 wherein said connector means comprises in combination;

a. at least one, first-type tubular hinge lug member which protrudes downwardly from at least one of said roof ribs, b. at least one, second-type tubular hinge lug member which protrudes inwardly from one of said inner surfaces of upper ends of said side panels, and c. a friction pin inserted into coaxially aligned bores within said first and second type tubular hinge lug members in interference fits therewithin.

20. The container of claim 19 wherein said side panels of said container are further defined as having at upper peripheral edges thereof horizontally disposed panel ribs having said inner surfaces from which said second type tubular hinge connector lugs protrude.

21. The container of claim 20 wherein said panel ribs are further defined as having a rectangular cross-sectional shape.

22. The container of claim 21 wherein at least one of said roof and panel ribs is further defined as being hollow.

23. The container of claim 20 wherein said panel ribs are further defined as having a right-triangular cross-sectional shape, said triangle having a downwardly and radially inwardly angled hypotenuse.

24. The container of claim 23 wherein at least one of said roof and panel ribs is further defined as being hollow.

25. In a storage container having a roof panel and upright members connected at upper ends thereof at corners of said roof panel, the improvement comprising a raised L-shaped stacking block fastened to said roof panel, said stacking block having a generally flat upper surface and interior vertical side walls forming with intersecting sides of said roof panel a rectangularly-shaped space connecting with an upper end of said upright, said upright having an end cap and a hoisting ring protruding upwardly from said end cap, said hoisting ring having an upper surface no higher than said upper surface of said stacking block.

26. The improvement of claim 25 wherein said end cap is angled diagonally downwardly from said inner intersection of said interior vertical side walls of said L-shaped stacking block, thereby facilitating draining water from said roof panel.

* * * * *